United States Patent [19]

Hemphill et al.

[11] Patent Number: 4,798,998

[45] Date of Patent: Jan. 17, 1989

[54] ELECTRONICALLY DIMMED POWER LIMITED LIGHTING SYSTEM

[75] Inventors: J. Marshall Hemphill; Roy D. Hoffer, both of Lancaster, Pa.

[73] Assignee: Armstrong World Industries, Inc., Lancaster, Pa.

[21] Appl. No.: 941,596

[22] Filed: Dec. 15, 1986

[51] Int. Cl.[4] ..... H05B 41/36

[52] U.S. Cl. ..... 315/297; 315/210; 315/217

[58] Field of Search ..... 315/324, 297, 210, 217, 315/161, 162; 361/377; 362/148, 150

[56] References Cited

U.S. PATENT DOCUMENTS

| | | | |
|---|---|---|---|
| 2,965,804 | 12/1960 | Roesel, Jr. et al. | 315/201 |
| 3,710,177 | 1/1973 | Ward | 315/244 |
| 4,233,545 | 11/1980 | Webster et al. | 315/154 |
| 4,293,799 | 10/1981 | Roberts | 315/220 |

*Primary Examiner*—David K. Moore
*Assistant Examiner*—T. Salindong

[57] ABSTRACT

A limited power, gaseous discharge lighting system, particularly suitable for use with suspended ceilings and for safe installation without shock and/or fire hazard and for rearrangement by non-electricians without special tools or experience, the light output of which is controlled by an electronic controller which responds to the ambient light available. The system uses non-armored flexible cables to supply individual relocatable gaseous discharge lighting fixtures and dimmers, and the cables are individually plugged into receptacles which furnish power strictly limited to permit the safe use of the cables, plugs and receptacles. High frequency operation permits efficient operation with rated light output and an electronic controller furnishes additional versatility and economy.

8 Claims, 4 Drawing Sheets

ELECTRONICALLY DIMMED POWER LIMITED LIGHTING SYSTEM

SUMMARY OF THE INVENTION

This invention deals generally with systems for electric lamp and discharge devices and more specifically with a power distribution system for gaseous discharge lamps which system operates at low voltage and with limited power and whose light output is controlled by an electronic dimming system.

One need only walk into a typical large office building to appreciate the great amount of power consumed by lighting. In most buildings virtually the entire ceiling of each floor is covered by row upon row of fluorescent light fixtures. Unlike residential lighting where specific work areas are lit by individual, movable lamps, most usable commercial space is usually lit to the full work level light intensity required by the most demanding tasks.

This is necessary because when the building is first constructed the lighting designer cannot anticipate the exact locations where light is needed, and yet in commercial and industrial areas only trained electricians are permitted to install standard ceiling lighting fixtures operating at rated electrical power. The designer, therefore, fully lights the entire area rather than force the later occupant to become involved with formal restructuring of the lighting systems. Such procedures lead to energy wasted by using excess lighting.

One approach to saving some of this energy has been to circulate the heat generated by the lighting system to use it for building heat, but such solutions gain nothing in those localities and seasons when cooling rather than heating is required.

The present invention approaches the problem from a different aspect, that of using a distribution system which can easily and safely be rearranged by nonelectricians. Such a system brings to lighting systems what has existed in wall structures for many years. Most large office complexes use movable room dividers to permit flexibility of office arrangements. However, prior to the present invention, no rearrangement of lighting was possible without using the services of a trained electrician for revising the lighting—the equivalent of moving permanently fixed walls.

The present invention includes a unique distribution system which permits changes of lighting arrangements in a much more casual manner, and is particularly advantageous for use with suspended ceilings. In such installations, the lighting fixtures themselves are typically supported by the ceiling grid and can be removed and relocated easily. In the prior art, however, the fixtures are wired with permanently attached armored cables connecting the fixtures to electrical power, so that the simple mechanical installation is completely negated by the semirigid electrical hook-up.

The present invention uses flexible nonarmored cable and plug-in electrical connections, but does so in a safe manner, which protects against fire and shock hazards. This new system of power distribution is such that it would prevent shock and/or fire hazards even in the familiar context of a typical residence. For instance, one embodiment is designed so that even if a child were to insert a metal object into the power receptacle and touch it, no harm would likely result.

Moreover, all embodiments of the present invention furnish fire protection from a short circuit. Again, in the context of a typical residence, if the flexible cable of the present invention were used as an extension cord, but, contrary to all safety considerations, placed under a high traffic area of carpet where damage to the cable insulation was likely to occur, nevertheless, there would be minimized risk of fire even if a short circuit did occur.

These results are supported by information from the National Electrical Code which permits the use of certain limited voltage and limited power systems which are considered to be free of shock hazard and/or free of fire hazard according to Articles 725 and others of the National Electrical Code published by National Fire Protection Association, Quincy, Mass. Typical familiar applications which fall into this category are door bell circuits, ringing circuits in telephone systems and fire alarm systems.

The present invention therefore furnishes a safe, versatile lighting system for use in commercial and industrial locations. This is accomplished by limiting the lighting system power to specific predetermined values which have been generally accepted for other low power circuits by the National Electrical Code and thereby enabling the use of a flexible cable in systems which are fire and/or shock hazard free. A plug-in connecting system is also used for the cables.

In the National Electrical Code, Class II power limited circuits, which are considered shock and fire hazard free, include circuits in which the open circuit voltage does not exceed 30 volts and having load currents inherently limited to 8.0 amperes, or, if not inherently limited to that value but including overcurrent protection, such protection must interrupt the current at 100 divided by the maximum voltage.

Such Class II circuits are permitted by the Code to use flexible non-armored or non-conduit cable wiring on the load side of the circuit.

The flexible cable assembly used in the present invention meets the National Electrical Code standards, and is generally conventional plastic covered multi-conductor cable. It is not armored with flexible metal conduit or rigid tubular conduit. Class II circuits require only that the conductors and insulation be "suitable for the particular application", while Class III specifies certain material (copper) and insulation sizes.

Class III circuits, which are considered only fire hazard free, also permit flexible non-armored cables, and are defined to include voltages up to 150 volts, providing the overcurrent protection interrupts the circuit current at one ampere. Below 100 volts, Class III circuits which are inherently current limited to 1,000 divided by the maximum voltage must also have overcurrent protection set at 1/10 this value. Class III circuits with inherent current limitation of 150 divided by the maximum voltage need no overcurrent protection.

Both classes limit the volt-amperes (VA) of the load or power source name plate rating to 100.

The present invention, although not specifically covered by the Code, operates within the limits set by Class II and Class III operation to yield a system which permits relocation of suspended ceiling light fixtures safely without special tools or experience and with minimized danger of shock or fire.

As will be apparent from the following and detailed descriptions, the specific limits for voltage and current parameters can be adjusted by the selection of specific component values. Thus, reduced fire hazard can be accomplished by the use of components which limit the voltage and power to certain values, and reduced fire and reduced shock hazard can be accomplished by selecting components to further limit the voltage and power.

In both situations, the basis of the present invention remains the same, to limit the voltage and the power to levels which will prevent fire and/or shock hazard while still assuring sufficient voltage and power to operate the light fixtures.

The invention uses a power limited source to operate gaseous discharge lamps with sufficient light output for commercial and industrial installations. One of the means of accomplishing this with higher efficiencies is raising the frequency above power line frequencies.

In the invention herein, "power limiting means" defines an element or elements which will limit power to no more than a predetermined output, herein the Class II or Class II limits. A fuse is not a power limiting means because it will deliver in excess of its rating for a finite period before it interrupts. The above definition is in conformity with the National Electric Code.

All embodiments of the invention use power from rated voltage electrical lines, 120 volts, 240 volts, 277 volts, etc. In one embodiment, these sources are connected to a number of rated voltage operated inverter power supplies, each such power supply providing for a plurality of outputs, with each such output being of limited power and of relatively high frequency. This goal is aided by a substantial inductive internal impedance, which is operative to limit the output current from each individual output to a maximum not exceeding a predetermined value. The invention will limit power output regardless of the electrical power source capacity. The invention will limit output power to not exceed a predetermined value regardless of the load conditions including short circuit.

The outputs of the inverter power supply, supplying high frequency, but voltage and current limited power, are connected to a plurality of pairs of flexible non-conduit conductor wires which are provided with easy plug-in connection at each of the several outputs of the individual inverter power supplies.

The flexible conductor wires connect to and feed the high frequency, limited power to a plurality of electronic controllers and fluorescent lighting units. Each lighting unit comprises one or more fluorescent lamps, an electric controller and a matching network operative to derive the requisite lamp operating voltages and currents (high voltage and low current for lamp ignition followed by lower voltage and higher current for lamp operation) from one of the limited outputs of one of the inverter power supplies.

The power provided to each lighting unit is provided at a high power factor, thereby permitting a power level of nearly 100 Watts to be provided to each lighting unit, which, with the indicate high frequency operation and with presently available high-efficiency fluorescent lamps, can provide nominal light output.

The present invention also furnishes additional benefits by controlling the lamp output to match the specific requirements of the lamp location.

In commercial and industrial buildings, lighting costs are of considerable significance, not only because the lighting is usually designed to flood the entire area with high intensity light, but also because the lighting is operated continuously for long periods of time regardless of the availability of alternate sources of light such as natural light. It is a common experience in office buildings to have all the room lights on and consuming full power for large portions of the workday while sunlight is streaming in the windows and furnishing more light than the electrical lights can furnish even at full power. Employees don't seem to think of turning off the lights when the workplace is lit by sunlight, even though such action would save considerable money.

The present invention presents a photocell controlled dimming system which is unique and advantageous because it responds very slowly. It therefore virtually ignores the variations of room light which occur on a day when clouds are quickly passing and blocking the sun for short periods. The electronic circuit is also particularly designed for high thermal and long term stability.

These benefits are accomplished by the use of a digital circuit which includes a very slow clock driving a digital counter through a large number of steps. Thus, even a single increment of change in lighting occurs relatively slowly, and changing the lighting level over its entire range, from off to full on, takes much longer than would normally be used.

The invention therefore furnishes a versatile lighting system in which several permanently wired and located inverter power supplies can supply power to a multitude of relocatable and electronically controlled fluorescent light fixtures, each connected to an inverter by flexible non-conduit cable and plug-receptacle combinations, but safely detachable and relocatable without experienced electricians.

DETAILED DESCRIPTION OF THE INVENTION

Figure 1:
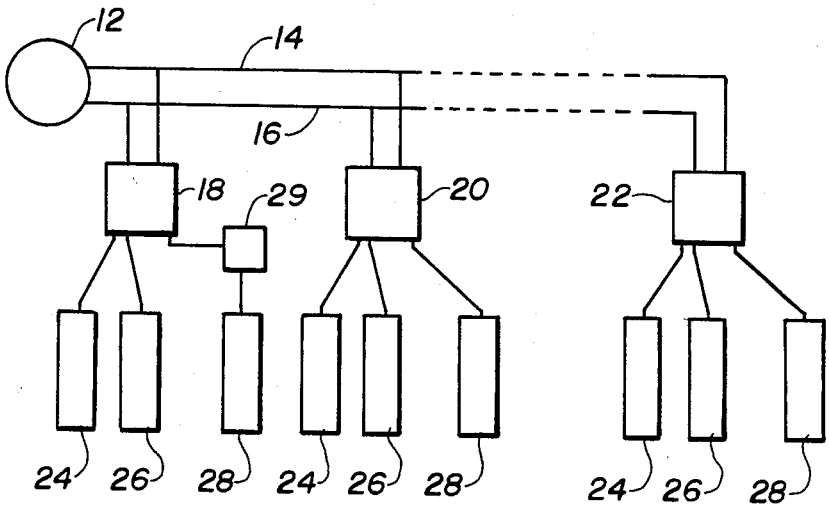
FIG. 1 schematically illustrates, from an overall systems viewpoint, the preferred embodiment of the invention; and shows a plurality of rated voltage operated inverter power supplies, each providing powerline isolated, current limited, high frequency AC voltage for operation of a number of individual gaseous discharge lighting units.

The preferred embodiment for the invention is shown in simplified block diagram form in FIG. 1.

In FIG. 1, a source 12 of rated voltage is applied to a pair of power line conductors 14 and 16. Connected at various points along this pair of power line conductors are a number of power line operated inverter power supplies 18, 20 and 22.

To each such rated voltage operated power supply are connected a number of gaseous discharge lighting units 24, 26 and 28. The number may be different for different power supplies at different system arrangements. Electronic controller 29 is shown typically inserted between power supply 22 and lighting unit 28 to furnish electronic dimming and/or control based upon the total light existing in the vicinity of lamp unit 28.

Figure 2:
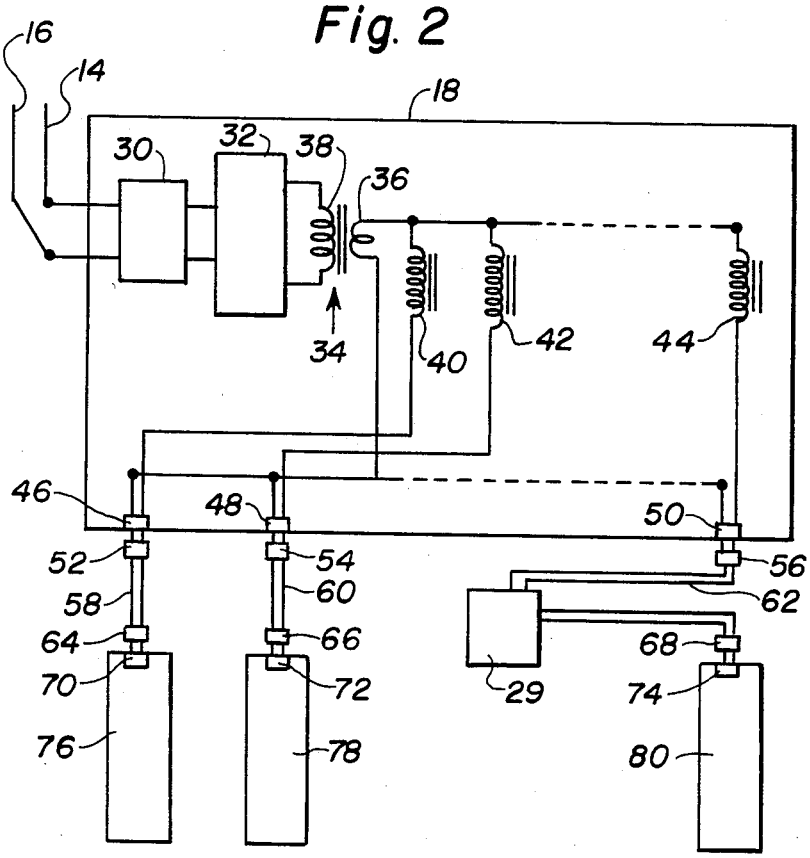
FIG. 2 schematically illustrates the first embodiment of one of said plurality of rated voltage operated power supplies and its multiple current limited outputs and corresponding individual connections with a number of gaseous discharge lighting units.

FIG. 2 illustrates in further detail one of the typical power supplies of FIG. 1 and its associated lighting units.

This typical power supply 18 is powered from power line conductors 14 and 16.

Inside 18, power line conductors 14 and 16 are directly connected with a rectifier-filter combination 30, the substantially constant DC output voltage of which is applied to an inverter 32.

The output from inverter 32 is a 30 kHz AC voltage, which AC voltage is applied to the primary winding 38 of an isolation transformer 34.

The output of transformer 34 is provided from its secondary winding 36 and is a 30 kHz AC voltage of approximately 30 Volt RMS magnitude. Secondary Winding 36 is electrically isolated from primary winding 38.

By way of a number of inductor means 40, 42 and 44, this transformer output voltage is supplied to a number of power output receptacles 46, 48 and 60, respectively.

By way of male plugs 52, 54 and 56 conduction wire-pairs 58, 60 and 62 and female plugs 64, 66 and 68, the output receptacles 46, 48 and 50 are connected with input receptacles of 70 and 72 on lighting units 76 and 78 and with electronic controller 29.

The assembly consisting of rectifier and filter means 30, inverter 32, transformer 34 and the output receptacles 4,6 48 and 50 is referred to as power supply 18.

Figure 3:
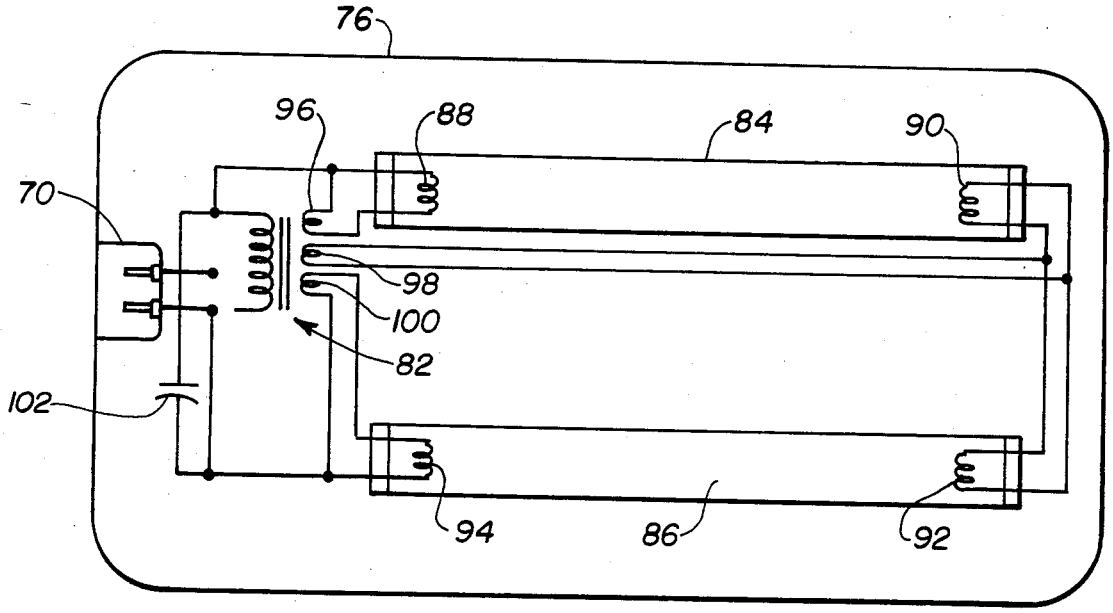
FIG. 3 schematically illustrates electrical circuit details of a first embodiment of a fluorescent lighting unit usable within the system shown in FIGS. 1 and 2.

FIG. 3 illustrates one of the typical lighting units referred to in FIG. 2 as 76, 78 and 80. This typical lighting unit is referred to as 76 and has a power input receptacle 70.

Inside lighting unit 76 is a voltage step-up auto-transformer 82, the input side of which is directly connected with input receptacle 70 and the output side of which is directly connected across a series combination of two fluorescent lamps 84 and 86.

Fluorescent lamp 84 has two cathodes 88 and 90; and fluorescent lamp 86 has two cathodes 92 and 94.

Auto-transformer 82 has three secondary windings 96, 98 and 100, all of which are electrically isolated from one another as well as from the input side of auto-transformer 82.

Secondary winding 96 is directly connected with cathode 88; secondary winding 98 is directly connected with a parallel-connection of cathodes 90 and 92; and secondary winding 100 is directly connected with cathode 94.

Capacitor 102 is connected directly across the output side of auto-transformer 82.

Operation of Power Limiting Feature

The operation of the system and circuits illustrated in FIGS. 1 to 3 may be explained as follows:

In FIG. 1, the pair of powerline conductors 14 and 16 provides rated voltage power to each and every inverter power supply: 18, 20 and 22.

Each inverter power supply converts its rated input voltage to a plurality of powerline isolated power limited, high frequency, limited magnitude AC voltage outputs. Each such AC voltage output is connected with a lighting unit, powering this lighting unit by way of said power limited, high frequency, limited magnitude AC voltage, with some units controlled by electronic controller 29, as described in greater detail below.

FIG. 2 shows how said powerline isolated, power limited, high frequency, limited magnitude AC voltage outputs are obtained.

The powerline voltage is applied to a rectifier-filter combination of conventional construction; and the output, from this rectifier-filter combination is a substantially constant DO voltage. This DC voltage is inverted by conventional inverter 32, typical of that described in U.S. Pat. No. 4,184,128, to a 30 kHz AC voltage of essentially squarewave shape.

This 30 kHz squarewave inverter output voltage is applied to the primary winding of voltage step-down, high frequency transformer 34; which transformer is of conventional construction.

This transformer also provides for electrical isolation between its primary and secondary windings, thereby providing for the extra safety of powerline isolation of the AC voltage outputs from power supply 18.

The output of the secondary winding 36 of transformer 34 is a 30 kHz unlimited power, essentially squarewave shaped AC voltage with a substantially constant RMS magnitude of about 30 Volts; which AC voltage is provided to the power output receptacles 46, 48 and 50 of power supply 18 by way of inductors 40, 42 and 44.

Thus, the magnitude of the current available at any one of these power output receptacles is limited by the reactance of the inductor connected in series circuit with that receptacle. The magnitude of the reactance of this inductor is chosen such that the current resulting when a given output receptacle is short circuited is no higher than 8 Amp RMS.

The high frequency AC voltage output from each of the power output receptacles is applied to a fluorescent lighting unit by way of a conduction wire pair and its associated male plug and female receptacle.

FIG. 3 shows how the individual lighting units work and more particularly, how the ballasting of the fluorescent lamps is accomplished in conjunction with series inductances 40, 42 and 44.

The output from one of the output receptacles of power supply 18 is applied by way of a conduction wire pair to power input receptacle 70 of lighting unit 76, from where it is applied directly to a voltage stepup transformer 82, the output of which is applied directly across two series connected fluorescent lamps 84 and 86.

The actual ballasting of the two fluorescent lamps is accomplished by way of resonant interaction between capacitor 102 which is connected in parallel across the two series connected fluorescent lamps 84 and 86 and the particular inductor 40 located in the power supply 18 feeding power to the lighting unit 76.

In other words, part of the ballasting function for the two fluorescent lamps 84 and 86 of lighting unit 76 is accomplished by way of inductor 40 within the power supply 18.

The rest of the circuit functions within lighting unit 76, such as the provision of cathode heating by way of the three secondary windings on transformer 82, is accomplished in manners well understood by those skilled in the art.

It should be noted that any of the lighting units, such as lighting unit 76, may consist of any number or types of lamps; and that these lamps might even be mounted in different locations or located in different lighting structures or fixtures. However, within the context of the present invention, it is important that all the lamps powered from a single output from any of the inverter power supplies, be ballasted as a single entity and that the aggregate Volt-Ampere product drawn from this output not exceed 100 VA.

It should also be noted that, due to the resonant matching of the fluorescent lamp loads to the source of high frequency power, the current drawn from the inverter power supplies by the different lighting units will be nearly sinusoidal in waveshape; and it will be substantially in phase with the fundamental component of the squarewave AC voltage outputs provided by these power supplies. As a result, the power drawn by the lighting units is drawn with a high power factor, which implies a maximization of the power available within a set limit of Volt-Amperes. Moreover, resulting electromagnetic interference by radiation from lamps and conductor wires is minimized.

Yet another thing that should be noted is the fact that capacitor 102, which is shown in FIG. 3 as being connected across the primary side of transformer 82, may just as well be connected across the secondary side of transformer 82. In fact, to provide for the desired power factor correction, capacitor 102 may even be connected in series with the output or input side of transformer 82.

Figure 4:
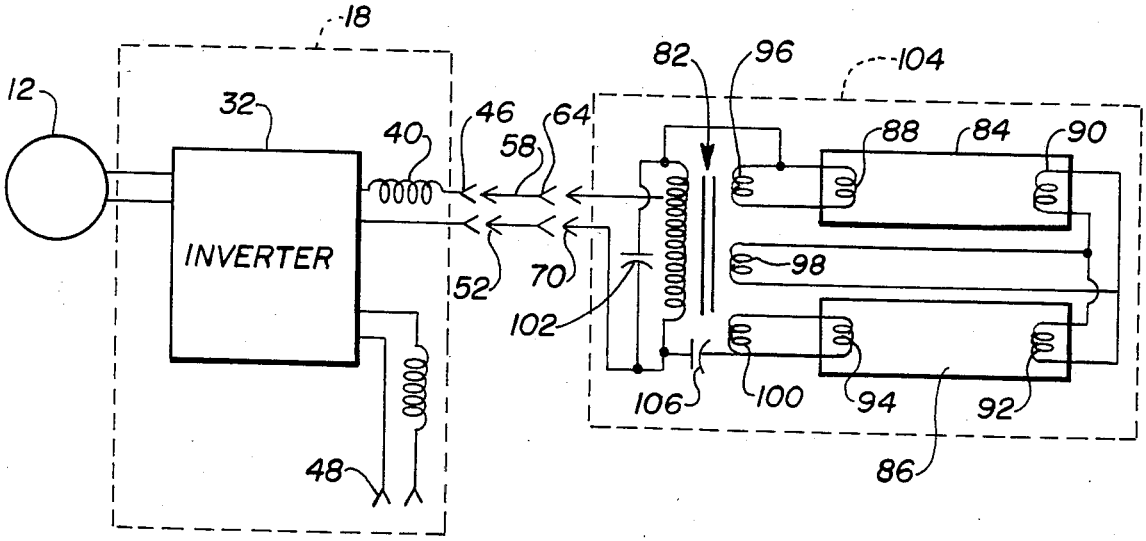
FIG. 4 is a simplified schematic diagram of an alternate embodiment of a resonant circuit system for use in the described system.

FIG. 4 depicts an alternate embodiment of a resonant circuit ballast in simplified schematic form. This ballast circuit, like that shown in FIG. 3, is used with inverter 32, a limiting means such as an inductor 40, output receptacle 46, male plug 52, wire-pair 58, female plug 64 and input receptacle 70, in a system as previously described in regard to FIGS. 1 and 2.

Fixture 104 of FIG. 4, however, differs from fixture 76 depicted in FIG. 3 in that, in addition to the direct wire connection between the primary winding of transformer 82 and secondary winding 96, the direct wire connection is supplemented by capacitor 106 connected between the primary winding and secondary winding 100.

The circuits of FIG. 3 and FIG. 4 both operate in the following manner. Before lamps 84 and 86 ignite the voltage supplied to them is increased by the interaction of capacitor 102 and transformer 82. As a result, the voltage developed across capacitor 102, and therefore across lamps 84 and 86 as well, is sufficient to cause ignition of the discharge in lamps 84 and 86. Upon ignition, the circuit will become loaded which causes the voltage across receptacle 70 to be reduced to normal lamp operating voltage.

It should be noted that the safety goals of the circuits are met including the starting conditions by the operation of the limiting means shown diagrammatically as inductor 40. The limiting means of FIG. 4 could be a series inductor 40, as shown, to meet Class III or a circuit that is a combination of a constant voltage source and a current limiter to meet Classes II and III.

The difference in operation of the circuit of FIG. 4 caused by the addition of capacitor 106 is that capacitor 106 adds phase correction and power factor improvement.

In both FIG. 3 and FIG. 4, however, the cathode heating circuits have a decided effect in the starting operation. Initially, before cathodes 88, 90, 92 and 94 have reached their normal operating temperature, and are therefore relatively low in resistance, they create a heavier current load on the circuit. They therefore load the circuit and the voltage across the lamp is momentarily limited on start-up until the cathodes have reached operating temperature. As the cathode temperatures increase, their resistances increases, the currents decrease, and the loading action diminishes. The voltage across capacitor 102 therefore, does not instantaneously jump on start-up and, more importantly, it does not subject the lamps to a higher voltage until the cathodes are properly heated. This action, which may be called "soft" starting, increase the life and reliability of lamp 84 and 86.

Figure 5:
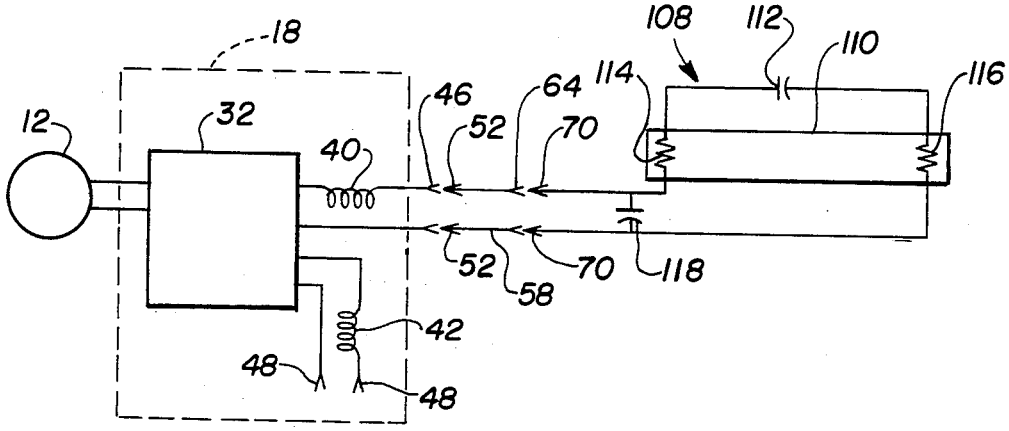
FIG. 5 is a simplified schematic diagram of a third alternate embodiment of a resonant circuit system for use in the described system.

FIG. 5 depicts another embodiment which is a highly simplified version of the present invention. This embodiment, which can also be used in the system shown in FIGS. 1 and 2, includes ballast circuit 108 as shown in U.S. Pat. No. 3,710,177 which, operating in conjunction with source limiting inductor 40 of the present invention, operates single lamp 110, but as described previously assures that voltage and power levels are always within the limits of fire safety. In FIG. 5, when voltage is applied to lamp 110 by inverter 32 through limiting inductor 40, capacitor 112, in series combination with limiting inductor 40, causes the circuit to resonate and a high voltage is impressed across lamp 110. Also, the high resonant current passes through cathodes 114 and 116 to overheat them and encourage fast starting. When the discharge is established within lamp 110, the discharge current acts as a shunt resistance across capacitor 112 shifting the operation point somewhat and reducing both the voltage across the lamp and the current through cathodes 114 and 116. Capacitor 118 is an optional addition to the circuit to better adjust it for optimum operation.

When the current operates at or near resonance, power factor is optimized, and, because of the sinusoidal current, radio frequency interference is also reduced. An additional advantage of the configuration of FIG. 5 is the self compensation of cathode heating current with lamp output, providing for decreased cathode current when cathode heating is provided by the discharge current. Lamp voltage is characteristically inversely proportional to discharge current. As such, increasing discharge current is accompanied by decreasing lamp and capacitor voltage, which results in diminished cathode current and increased lamp efficacy. Conversely, as lamp output and the discharge current decrease, cathode filament heating current will increase, and provide additional cathode heating to compensate for the reduction in heating resulting from the diminished discharge current.

Figure 6:
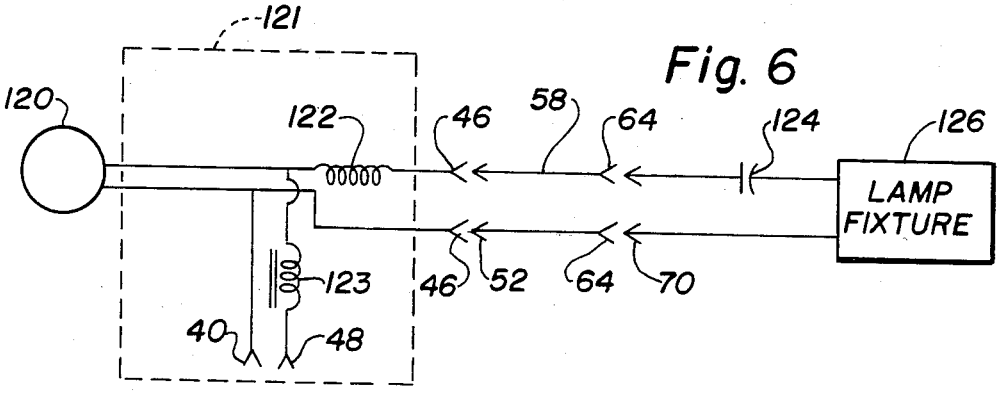
FIG. 6 is a simplified schematic diagram of a system of power limitation operable directly at rated power line frequencies.

FIG. 6 is a further embodiment of the present invention and is perhaps the simplest of all. Most important, it uses conventional power source 120 operating at rated power line frequency and voltage and also uses conventional fluorescent lamp fixture 126. It differs from conventional plug-in fluorescent lamp circuits, however, in that, because of proper choice of value for inductors 122 and 123, located within power supply 121, all circuit elements on the load side of inductors 122 and 123 are protected from fire hazard.

Capacitor 124 is located in series with limiting inductor 122 and selected so that, considerating inductive components in standard lamp fixture 126, it will cause the entire circuit to resonate at the frequency of power supply 120. Thus the series circuit of limiting inductor 122, capacitor 124 and lamp fixture 126, including reactances within the fixture and from the system wiring, are designed to be resonant at the power supply frequency, even though that frequency is as low as 60 Hz. Inductor 122 is also selected with the criteria that its reactance must be such that, if a short circuit occurs on its load side, the ampere output will be limited to a safe value. It should be noted that part of the inductance of the resonant circuit can be located other than within power supply 121.

In specific terms, that means that for the fire safety case, the reactive impedance of inductor 120 must be at least 120 ohms for a 120 volt rated power source, and at 60 Hz that requires an inductance of approximately 0.32 Henries. Capacitor 124, to resonate the circuit, assuming no additional inductance in lamp fixture 126, must have a value of approximately 22 microfarads.

Such values could therefore furnish a safe, versatile lighting system which can be rearranged by virtually anyone.

Figure 7:
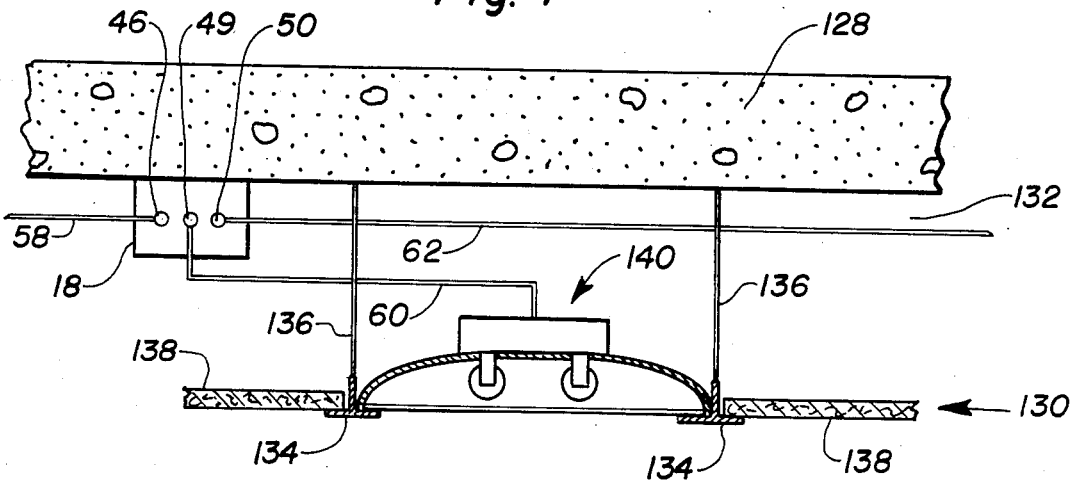
FIG. 7 is a schematic illustration of the invention herein used in a suspended ceiling system.

FIG. 7 is a showing of the invention herein being used within a suspended ceiling system. The structural ceiling 128 of a normal commercial building is a poured concrete structure. A suspended ceiling assembly 130 is normally mounted below the structural ceiling 128 to define a space called the plenum 132 between ceiling 128 and assembly 130. In the plenum Would be placed air handling means, electrical wiring, etc.

The ceiling assembly 130 is composed of runners 134 suspended by wires 136 from the ceiling 128. The runners are arranged in a grid pattern to form the support structure for the ceiling boards 138 and ceiling lights 140 that complete the ceiling assembly. Normally the ceiling light receives its power from wires that are placed in armored conduit as required by the National Electrical Code. Due to the inventive circuitry herein. non-armored flexible cable means 58, 60 and 62 may be used to supply power to the lights. Power line operated inverter power supply 18 (see FIGS. 1 and 2) has plural power receptacles 46, 48 and 50 (see FIG. 2). Plug and receptacle disconnect means are positioned on at least one end of each cable means and connect each power receptacle to an individual ceiling light assembly 140. The ceiling light assembly 140 of FIG. 7 is part of the suspended ceiling system in that it is in the plane of the ceiling assembly 130 or suspended therefrom. FIG. 4 shows a type of power supply, disconnect cable means and light assembly combination that could be used in the structure of FIG. 7.

Figure 8:
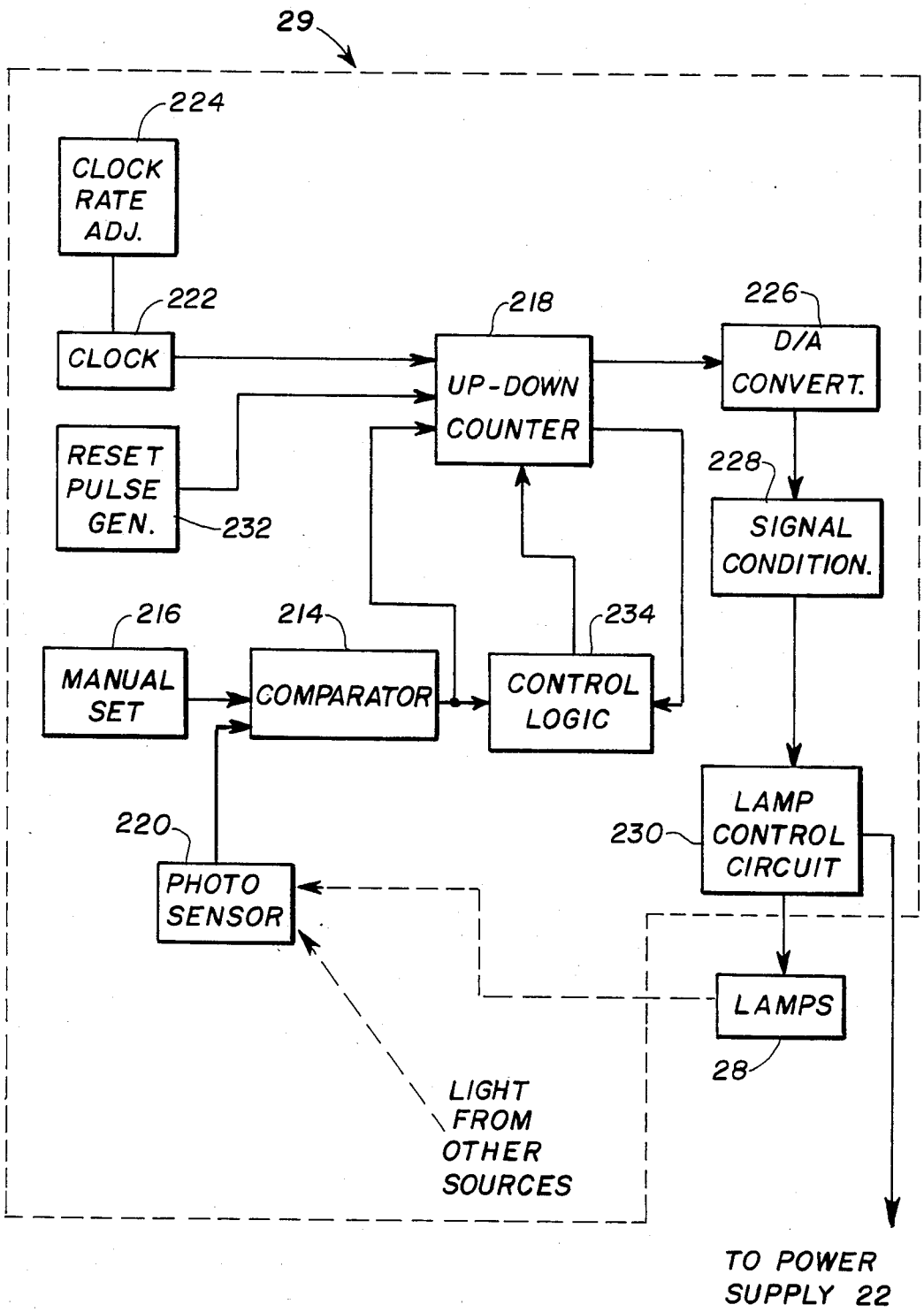
FIG. 8 is a simplified electronic block diagram of a digital circuit used as the electronic controller of the invention.

The preferred embodiment of the electronic controller of the invention is depicted in simplified block diagram form in FIG. 8, in which electronic controller 29 controls lamps 28 as designated in FIG. 1.

The control sequence depends upon photo sensor 220 which converts the light from both lamps 28 and other sources (not shown) into electrical signals, related to the quantity of light to which photo sensor 220 is subjected, which are fed to signal comparator 214. In the preferred embodiment photo sensor 220 is a photoresistor which is one leg of a voltage divider.

Comparator 214 also receives an electrical signal from manual setting adjustment 216, which in the preferred embodiment is a simple manually controlled voltage source. Thus, manual setting adjustment 216 feeds a fixed manually controlled voltage to one input of comparator 214 while variations in light intensity falling upon photosensor 220 produce voltage variations on the other input of comparator 214. When the two inputs differ, comparator 214 sends a signal to binary counter 218 to command it to count either up or down depending on whether more or less intensity is required from lamps 28 to meet the standard set by manual setting adjustment 216.

It should be apparent that photosensor 220 disregards the specific source of light, whether it is the lamps being controlled, outside light coming through windows, or another source of artificial light independent of the control circuit. Therefore, any increase in general light level will cause a reduction in this light being produced by lamps 28, and, of course, save electrical power used to produce that light. This is true no matter whether the increase in general light level is due to sunlight or lamps 28 themselves.

The circuit similarly senses and counteracts decreased general light levels. This is particularly beneficial if external factors cause light variations in lamps 28 themselves. If, for instance, the age of lamps 28 or the ambient temperature of the environment causes reduced light output, the circuit compensates by increasing the power to lamps 28.

However, unlike other conventional lamp control circuits, the change is not instantaneous. The present invention specifically uses a slow rate of change of light intensity which prevents momentary changes which must merely be quickly returned to the previous control setting. This action is accomplished by using a very slow clock signal, generated by clock 222. The clock frequency is fed to binary counter 218 and is the signal that determines the rate at which binary counter 218 actually counts when commanded to do so by comparator 214. While typical clock pulses used in most digital circuits operate at thousands or even hundreds of thousands of Hz., the present invention uses a clock rate of 0.2 to 5.0 Hz. In the preferred embodiment the rate used is 1.0 Hz.

This slow rate is adjustable by clock rate adjustment 224 which is manually adjustable in the field so the circuit response can be tailored to the specific conditions of the environment in which it is installed.

The slow clock rate is used in conjunction with the counting register or rang of binary counter 218 to determine the full control characteristics of the system. Thus the number of settings available from binary counter 218, that is the number of units it can count, determines the number of increments into which the light intensity range is divided, or the fineness of the control. The preferred counting register for the invention is 100 to 500, and the register selected for the preferred embodiment is 256. The basic goal of the combination of clock rate and count register is to make the sweep of the entire counter register take more than 20 seconds.

The preferred embodiment uses a counting rate of 1 Hz and a counting register of 256, so that there are 256 steps in the control of lamps 28 and the steps are changed at the rate of one per second. Clearly, that results in the requirements of 256 seconds to sweep the entire range of lamp intensity. This slow change results in the major benefit of the present invention, inherent stability. Unless a significant change in general light intensity occurs for a relatively lengthy period of time, no perceptible change will occur in the intensity of lamps 28. That is not to say that changes will not be occurring. There will be changes as required, but they will be slow and imperceptible to the observer's eye.

The actual change in lamp intensity is accomplished by the count output from binary counter 218 being converted to an analog signal buy digital to analog converter 226. That signal is amplified or otherwise conditioned by signal conditioner 228 and fed to a conventional lamp control circuit 230 which then varies the power supplied to lamps 28.

Reset pulse generator 232 and control logic circuit 234 are auxiliary circuits to control binary counter 218. Reset pulse generator 232 is used to reset the counting register of binary counter 218 to a specific count level when power is first applied to the circuit. This point would normally be full brightness for ease of immediate access to the area being lit. However, it may be desirable to select some lower power level to limit the surge currents to which the lamps and power circuit are subjected.

Control logic circuit 234 determines the counting register of binary counter 218. It stops the up count at the number selected, for instance, in the case of the preferred embodiment, 255, and stops the down count at zero. In each case it also determines that the counting process will reverse rather than instantaneously cycle to the other extreme.

Electronic controller 29 as described furnishes a highly stable light intensity control which not only accommodates to external light sources, but also adjusts for any internal factors which affect light output.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention a defined in the following claims.

For example, sodium vapor lamps may be used in place of conventional fluorescent lamps, and multiple lamps may be located in a single fixture with each lamp separately powered by a circuit such as that shown in FIG. 5. Conversely, multiple lamps in a circuit such as that shown in FIG. 3 could each be placed in different localities but be interconnected. Moreover, in many of the embodiments, the locations of inductive and capacitive reactances could be interchanged and resonance and power limitation could be maintained. This is particularly so for the circuit of FIG. 6.

What is claimed is:

1. A lighting system comprising:

(a) an electrical power source;

(b) at least one power supply connected to the electrical power source, said power supply containing a parallel connected power distributing means which provides electrical power to at least two separate independently operable power outputs;

(c) power limiting means connected within said power supply to individually limit the electrical power to at least two separate power output to a specific fire and/or shock hazard free predetermined value regardless of the electrical power available from the electrical power source;

(d) plural non-armored flexible cable means, each with plug and receptacle disconnect means, one end of each being connected to a power output of the power supply and a second end being connected to a gaseous discharge lighting means;

(e) the gaseous discharge lighting means operable from the limited power available from one power output of the power supply; and (f) an electronic controller connected to the gaseous discharge lighting means and operating to control the level of its light output based upon the setting of a manual setting means connected to the electronic controller; said controller comprises;

(1) a photo sensor located to be affected by available light, including light from lamps being controlled by the lamp controller, and generating an electrical signal related to the quantity of light to which it is subjected;

(2) a manual setting means generating an electrical voltage related to the setting of a manual control;

(3) a signal comparator electrically connected to the photo sensor and to the manual setting means, receiving electrical signals from both, and generating an output of a command signal which varies with the relationship between the signals received from the photo sensor and the manual setting means;

(4) an electronic up-down counter electrically connected to the output of the signal comparator, receiving the command signal from the signal comparator, counting up or down in its register depending upon the command signal received, and generating an output signal varying with the level of the count on its register;

(5) a clock means electrically connected to the up-down counter and generating and feeding to the up-down counter a signal which repeats at a frequency determined by the clock means, the repeating signal acting upon the up-down counter to determine the rate at which the up-down counter changes the level of its count; and (6) lamp control means; receiving electrical signals from the up-down counter and varying the electrical power applied to at least one lamp according to the level of the count of the up-down counter.

2. The lighting system of claim 1 wherein the up-down counter generates a digital output signal and further including a digital to analog converter inserted in the signal path between the up-down counter and the lamp control means

3. The lighting system of claim 1 wherein the frequency generated by the clock is in the range of 0.2 Hz to 5.0 Hz.

4. The lighting system of claim 1 wherein the total count available in the register of the up-down counter is less than 500.

5. The lighting system of claim 1 wherein the time required for the up-down counter to sweep its entire register is at least 20 seconds.

6. The lighting system of claim 1 wherein the frequency of the clock means is adjustable.

7. The lighting system of claim 1 further including a reset pulse generator, electronically connected to the up-down counter, which resets the up-down counter to a predetermined count level when electrical power is first applied to the electronic controller.

8. The lighting system of claim 1 further including a control logic circuit electrically connected to the up-down counter and determining the limit of its count.

* * * * *